US011466683B2

(12) United States Patent
Deguchi

(10) Patent No.: US 11,466,683 B2
(45) Date of Patent: Oct. 11, 2022

(54) COMPRESSOR

(71) Applicant: DAIKIN INDUSTRIES, LTD., Osaka (JP)

(72) Inventor: Ryohei Deguchi, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/049,532

(22) PCT Filed: Mar. 27, 2019

(86) PCT No.: PCT/JP2019/013349
§ 371 (c)(1),
(2) Date: Oct. 21, 2020

(87) PCT Pub. No.: WO2019/208079
PCT Pub. Date: Oct. 31, 2019

(65) Prior Publication Data

US 2021/0254620 A1 Aug. 19, 2021

(30) Foreign Application Priority Data

Apr. 24, 2018 (JP) ..... JP2018-083147

(51) Int. Cl.
*F04C 18/02* (2006.01)
*F04C 29/02* (2006.01)
(Continued)

(52) U.S. Cl.
CPC ..... *F04C 18/0215* (2013.01); *F04C 18/356* (2013.01); *F04C 23/008* (2013.01);
(Continued)

(58) Field of Classification Search
CPC ..... F04C 2240/807; F04C 2240/40; F04C 29/0021; F04C 18/0215; F04C 18/356; F04C 29/02; F04C 29/026
See application file for complete search history.

(56) References Cited

U.S. PATENT DOCUMENTS

2012/0107151 A1* 5/2012 Yokoyama ..... F04C 23/02 417/366
2012/0269667 A1 10/2012 Sakima et al.
2017/0254331 A1 9/2017 Noro et al.

FOREIGN PATENT DOCUMENTS

JP 9-14165 A 1/1997
JP 2001-218411 A 8/2001
(Continued)

OTHER PUBLICATIONS

European Search Report of corresponding EP Application No. 19 79 2296.6 dated Dec. 7, 2020.
(Continued)

*Primary Examiner* — Mark A Laurenzi
*Assistant Examiner* — Xiaoting Hu
(74) *Attorney, Agent, or Firm* — Global IP Counselors, LLP

(57) ABSTRACT

A compressor includes a motor, a balance weight and a partition. The motor includes a rotor having a first end surface and a second end surface. The balance weight is disposed on the first end surface or the second end surface. The partition is disposed on the first end surface or the second end surface. The rotor has a through hole extending from the first end surface to the second end surface. The partition divides, from the through hole, at least one of a front region and a rear region. The front region is located in front of a front edge of the balance weight in a rotational direction of the rotor. The rear region is located behind a rear edge of the balance weight in the rotational direction of the rotor.

6 Claims, 12 Drawing Sheets

(51) Int. Cl.
*F04C 23/00* (2006.01)
*F04C 18/356* (2006.01)
*F04C 29/00* (2006.01)

(52) U.S. Cl.
CPC ..... *F04C 29/026* (2013.01); *F04C 29/0021* (2013.01); *F04C 2240/40* (2013.01); *F04C 2240/60* (2013.01); *F04C 2240/807* (2013.01)

(56) References Cited

FOREIGN PATENT DOCUMENTS

| | | | | |
|---|---|---|---|---|
| JP | 2004-239099 | A | 8/2004 | |
| JP | 2007-205282 | A | 8/2007 | |
| JP | 5025556 | B2 | 6/2012 | |
| JP | 5056779 | B2 | 10/2012 | |
| JP | 2013-253535 | A | 12/2013 | |
| JP | 6102866 | B2 | 3/2017 | |
| WO | WO-2005040610 | A1 * | 5/2005 | ..... F04C 29/0021 |

OTHER PUBLICATIONS

International Search Report of corresponding PCT Application No. PCT/JP2019/013349 dated Jun. 4, 2019.
International Preliminary Report of corresponding PCT Application No. PCT/JP2019/013349 dated Nov. 5, 2020.

* cited by examiner

COMPRESSOR

CROSS-REFERENCE TO RELATED APPLICATIONS

This U.S. National stage application claims priority under 35 U.S.C. § 119(a) to Japanese Patent Application No. 2018-083147, filed in Japan on Apr. 24, 2018, the entire contents of which are hereby incorporated herein by reference.

BACKGROUND

Field of the Invention

A compressor for use in, for example, a refrigeration machine.

Background Information

Japanese Patent No. 5,025,556 discloses a compressor including an electric motor. The electric motor includes a rotor having a plurality of rotor through holes. The rotor is provided with a balance weight. The balance weight has a front end portion in its rotational direction where a positive pressure relative to an operating pressure generates, and a rear end portion in its rotational direction where a negative pressure relative to the operating pressure generates. As a result, an upward flow occurs at some of the rotor through holes whereas a downward flow occurs at some of the rotor through holes.

SUMMARY

A phenomenon of oil loss in which a lubricating oil is discharged together with a refrigerant from a compressor affects the performance of the compressor. In order to suppress the oil loss, it is preferable to secure a sectional area through which an upward flow of the refrigerant passes. In the compressor disclosed in Japanese Patent No. 5,025,556, however, the downward flow occurs at some of the rotor through holes.

A first aspect provides a compressor including a motor, a balance weight, and a partition. The motor includes a rotor having a first end surface and a second end surface. The balance weight is disposed on the first end surface or the second end surface. The partition is disposed on the first end surface or the second end surface. The rotor has a through hole extending from the first end surface to the second end surface. The partition divides, from the through hole, at least one of a front region located in front of a front edge of the balance weight in a rotational direction of the rotor and a rear region located behind a rear edge of the balance weight in the rotational direction of the rotor.

According to this configuration, the partition divides at least one of the front region or the rear region from the through hole. A refrigerant flowing through the through hole is thus less susceptible to the influence of a positive pressure in the front region or a negative pressure in the rear region.

A second aspect provides the compressor according to the first aspect, wherein the partition divides both the front region and the rear region from the through hole.

According to this configuration, the partition divides both the front region and the rear region from the through hole. The refrigerant in the through hole is therefore less susceptible to the influence of each of the positive pressure and the negative pressure.

A third aspect provides the compressor according to the first or second aspect, wherein the partition is integrated with the balance weight.

According to this configuration, the partition is integrated with the balance weight. This configuration thus facilitates the assembly of the motor.

A fourth aspect provides the compressor according to the third aspect, wherein the through hole communicates with a hole in the partition.

According to this configuration, the through hole communicates with the hole in the partition. The partition is disposed between a crank shaft and the balance weight. Since the through hole is located near the crank shaft, the through hole is less likely to obstruct a flow of a magnetic field of an electromagnetic steel plate at an outer edge of the rotor.

A fifth aspect provides the compressor according to any one of the first to fourth aspects, further including a porous member covering the through hole.

According to this configuration, the through hole is covered with the porous member. The porous member thus captures a refrigerating machine oil passing therethrough together with a refrigerant, leading to a further reduction in oil loss.

A sixth aspect provides the compressor according to any one of the first to fifth aspects, further including a cover. The cover has a cylindrical shape, is fixed to the balance weight or the rotor, and covers the balance weight.

According to this configuration, the cover has the cylindrical shape, and covers the balance weight. The cover thus covers an asymmetric shape of the balance weight. This configuration therefore suppresses the stirring of the refrigerant and the refrigerating machine oil by the balance weight.

A seventh aspect provides the compressor according to any one of the first to sixth aspects, that is a rotary compressor or a scroll compressor.

According to this configuration, the compressor is of a rotary type or a scroll type. This configuration thus achieves a reduction in oil loss in a rotary compressor or a scroll compressor.

DETAILED DESCRIPTION OF EMBODIMENT(S)

First Embodiment (1) General Configuration

Figure 1:
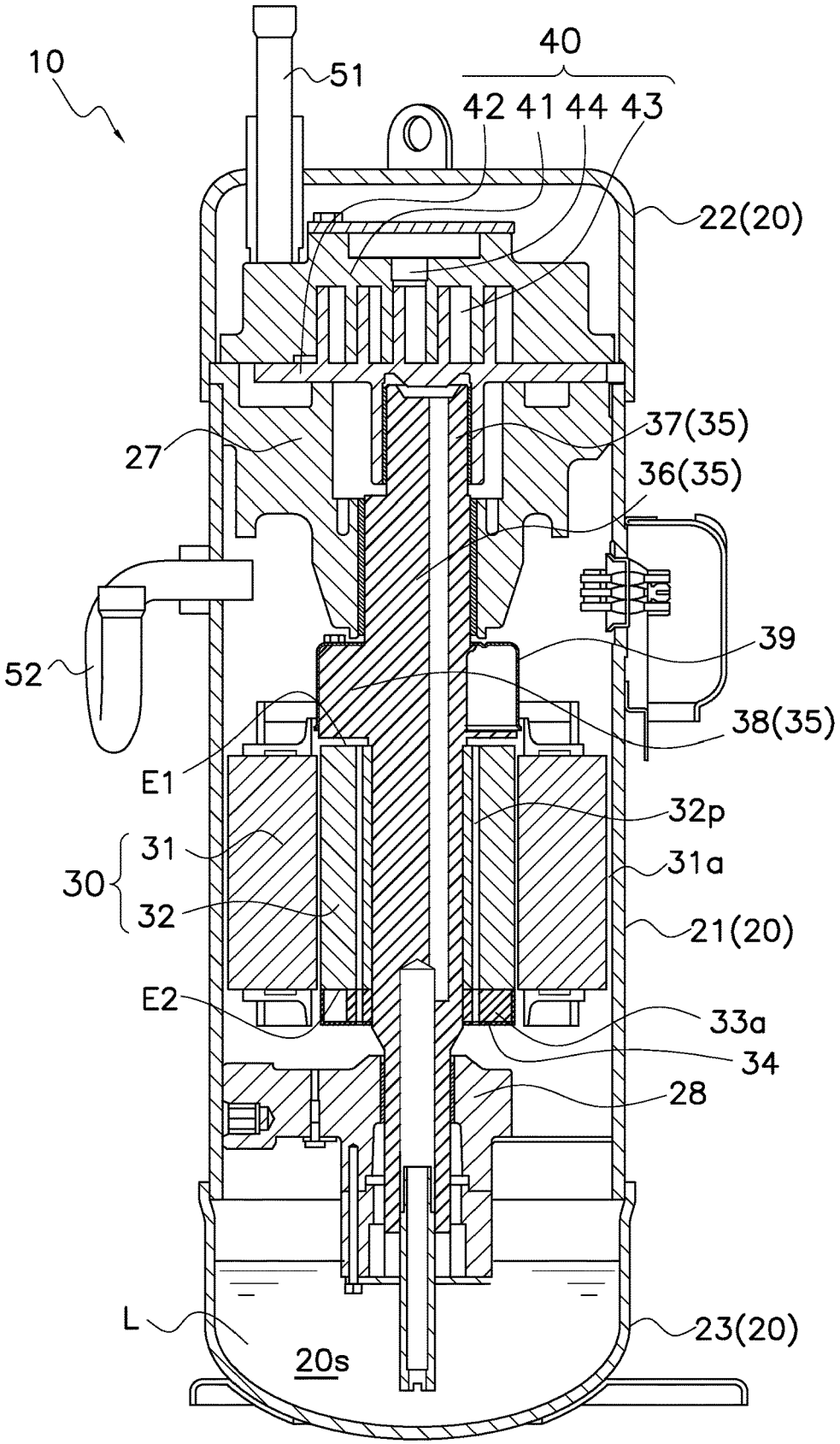
FIG. 1 is a sectional view of a compressor 10 according to a first embodiment.

FIG. 1 is a sectional view of a compressor 10 according to a first embodiment. The compressor 10 is a scroll compressor. The compressor 10 includes a casing 20, a motor 30, a crank shaft 35, a compression mechanism 40, a first support 27, a second support 28, a suction pipe 51, and a discharge pipe 52.

(2) Specific Configuration (2-1) Casing 20

The casing 20 accommodates the constituent components of the compressor 10 and a refrigerant and has strength capable of enduring a high pressure of the refrigerant. The casing 20 includes a cylindrical portion 21, an upper portion 22, and a lower portion 23 that are joined together. The casing 20 has on its lower inside an oil reservoir 20*s*. The oil reservoir 20*s* stores a refrigerating machine oil L.

(2-2) Motor 30

The motor 30 is configured to receive electric power and to generate power for the compression mechanism 40. The motor 30 includes a stator 31 and a rotor 32. The stator 31 is directly or indirectly fixed to the casing 20. The rotor 32 is rotatable by magnetic interaction with the stator 31.

The stator 31 has on its outer periphery a core cut portion 31*a*. The core cut portion 31*a* defines a clearance between the casing 20 and the stator 31. This clearance functions as a refrigerant passage.

The rotor 32 has a first end surface E1 on the upper side and a second end surface E2 on the lower side. The rotor 32 also has through holes 32*p*. Each of the through holes 32*p* extends from the first end surface E1 to the second end surface E2 of the rotor 32 in a direction along the rotational axis of the rotor 32. The through holes 32*p* also function as refrigerant passages.

A lower balance weight 33*a* is disposed on the second end surface E2 of the rotor 32. The lower balance weight 33*a* has an asymmetric shape with respect to the rotational axis of the rotor 32. The lower balance weight 33*a* stabilizes the rotation by adjusting the centers of gravity of the rotor 32 and crank shaft 35.

A lower cover 34 is fixed to the lower balance weight 33*a*. The lower cover 34 covers the asymmetric shape of the lower balance weight 33*a*, thereby suppressing the stirring of the refrigerant by the lower balance weight 33*a* during the rotation of the rotor 32.

Figure 4:
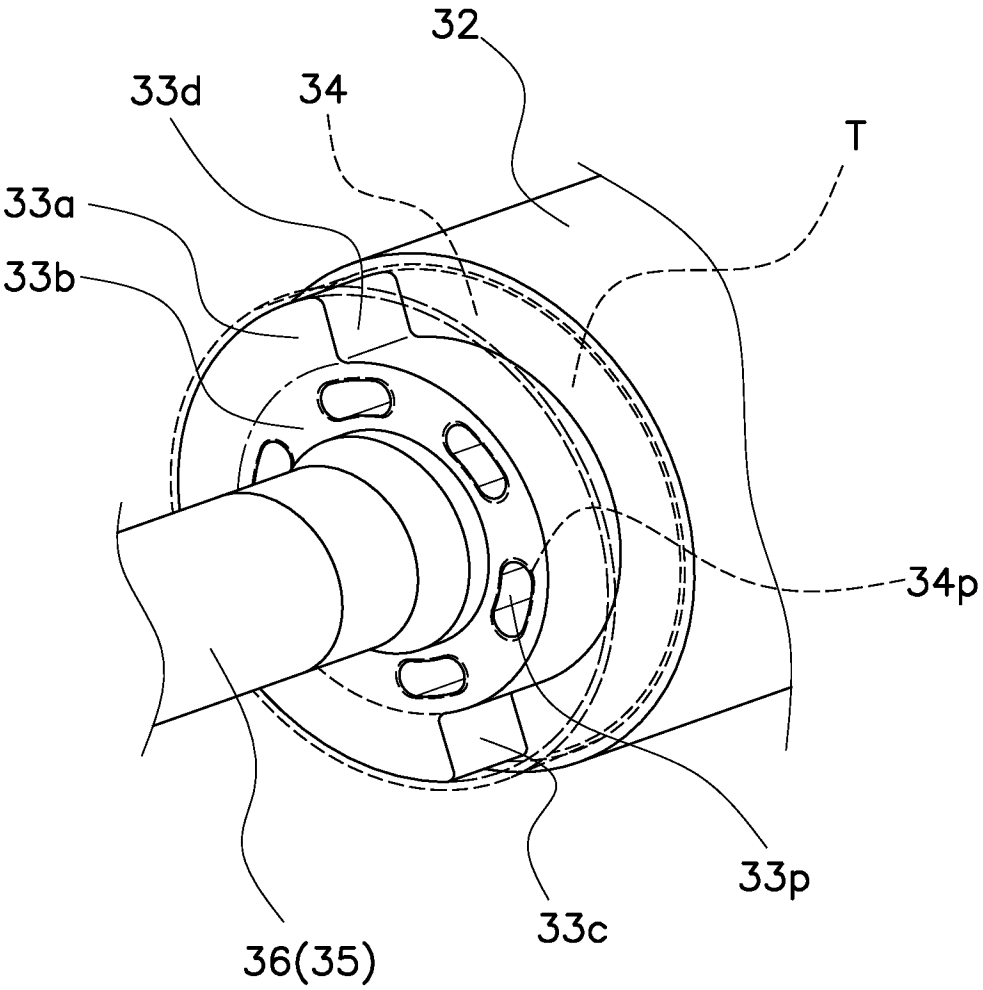
FIG. 4 is a perspective view of a lower balance weight 33*a* and the surroundings of the lower balance weight 33*a* in the compressor 10 according to the first embodiment.

The lower cover 34 has a plurality of holes 34*p* (FIG. 4).

(2-3) Crank Shaft 35

The crank shaft 35 is configured to transmit to the compression mechanism 40 power generated by the motor 30. The crank shaft 35 rotates together with the rotor 32. The crank shaft 35 includes a main shaft portion 36 and an eccentric portion 37. The main shaft portion 36 is fixed to the rotor 32 to rotate concentrically with the rotor 32. The eccentric portion 37 is eccentric from the main shaft portion 36, and is coupled to the compression mechanism 40. When the crank shaft 35 rotates, the eccentric portion 37 revolves.

Figure 2:
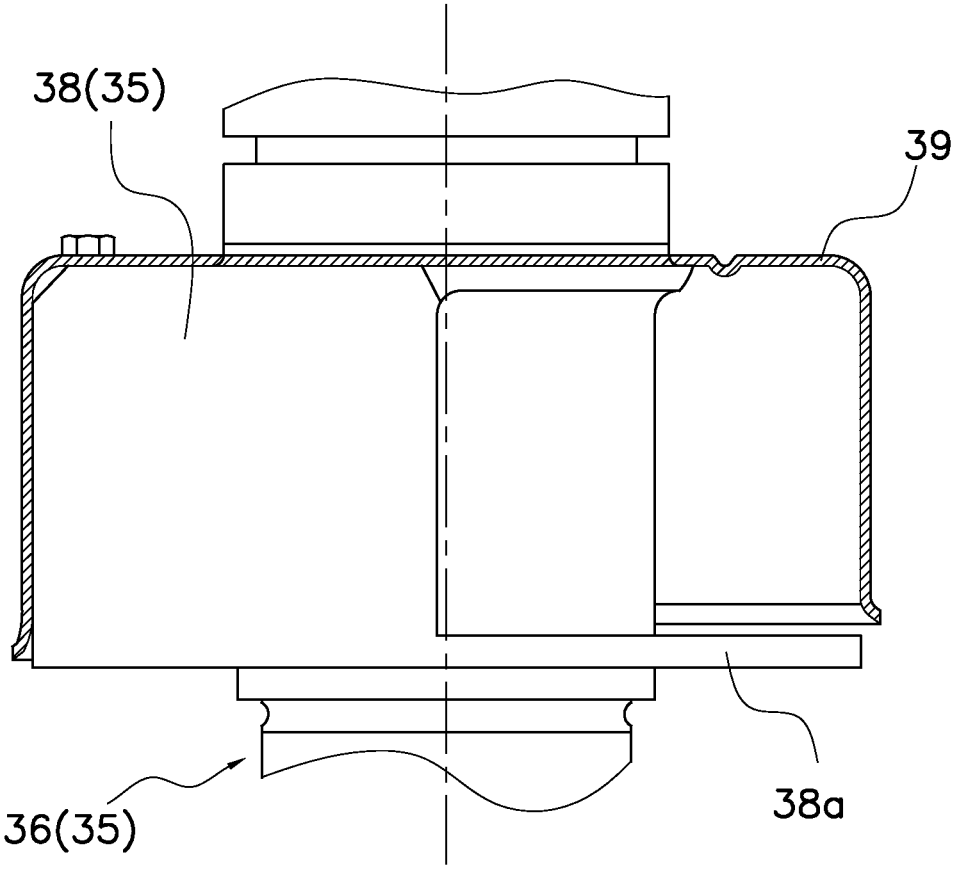
FIG. 2 is a sectional view of an upper balance weight 38.

The main shaft portion 36 includes an upper balance weight 38 located near the first end surface E1 of the rotor 32. The upper balance weight 38 stabilizes the rotation by adjusting the centers of gravity of the rotor 32 and crank shaft 35. As illustrated in FIG. 2, the upper balance weight 38 has an asymmetrical shape with respect to the rotational axis of the crank shaft 35. The upper balance weight 38 has on its lower portion a disk portion 38*a*. An upper cover 39 is disposed on the upper balance weight 38 including the disk portion 38*a*. The upper cover 39 covers the asymmetric shape of the upper balance weight 38, thereby suppressing the stirring of the refrigerant by the upper balance weight 38 during the rotation of the crank shaft 35.

(2-4) Compression Mechanism 40

Referring back to FIG. 1, the compression mechanism 40 is configured to compress a gas refrigerant which is a fluid. The compression mechanism 40 includes a fixed scroll 41 and a movable scroll 42. The fixed scroll 41 is directly or indirectly fixed to the casing 20. The movable scroll 42 is revolvable with respect to the fixed scroll 41. The fixed scroll 41 and the movable scroll 42 define a compression chamber 43. The movable scroll 42 revolves while following the revolution of the eccentric portion 37. This causes a variation in volume of the compression chamber 43 in which the gas refrigerant is thus compressed. After the compression stroke, the high-pressure gas refrigerant is discharged from the compression mechanism 40 through a discharge port 44 in the fixed scroll 41, and then flows into and fills the space inside the casing 20.

(2-5) First Support 27, Second Support 28

The first support 27 supports the main shaft portion 36 of the crank shaft 35 in a rotatable manner. The first support 27 is directly or indirectly fixed to the casing 20. The first support 27 may directly or indirectly support the fixed scroll 41.

The second support 28 supports the main shaft portion 36 of the crank shaft 35 in a rotatable manner. The second support 28 is directly or indirectly fixed to the casing 20.

(2-6) Suction Pipe 51, Discharge Pipe 52

The casing 20 is provided with the suction pipe 51 through which the refrigerant is sucked into the casing 20, and the discharge pipe 52 through which the refrigerant is discharged from the casing 20.

The suction pipe 51 is disposed for sucking the low-pressure gas refrigerant and guiding the low-pressure gas refrigerant to the compression chamber 43. The suction pipe 51 is fixed to the upper portion 22.

The discharge pipe 52 is disposed for discharging to the outside from the casing 20 the high-pressure gas refrigerant flowing into the space in the casing 20 through the discharge port 44. The discharge pipe 52 is fixed to the cylindrical portion 21.

(3) Flow of Refrigerant

Figure 3:
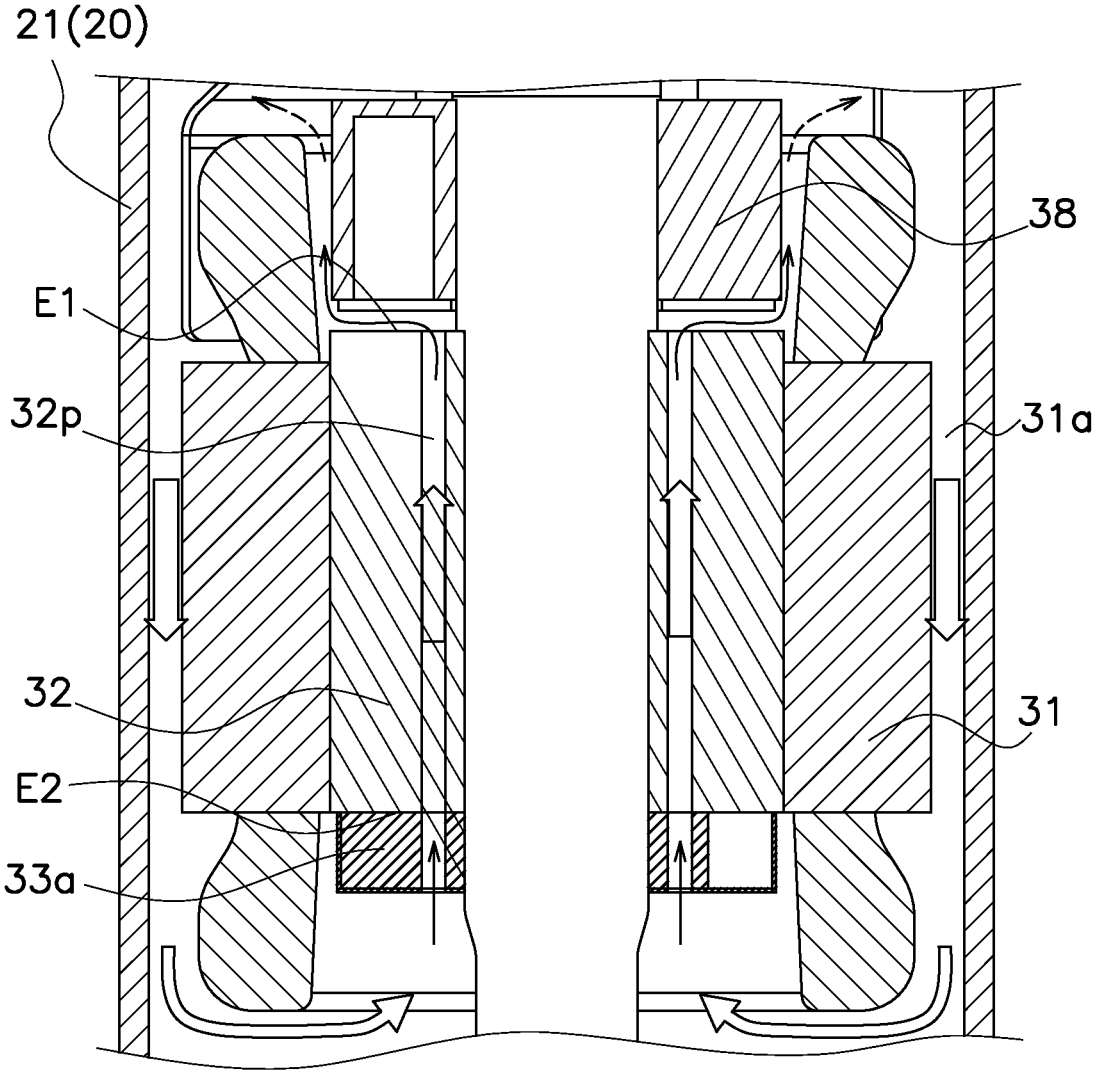
FIG. 3 is a diagram of a refrigerant flow in a casing 20.

The refrigerant, which is compressed by the compression mechanism 40, is discharged from the compression mechanism 40 through the discharge port 44. As illustrated in FIG. 3, the refrigerant then passes the clearance in the core cut portion 31*a*, and flows downward. The refrigerant then passes each through hole 32*p* in the rotor 32, and flows upward. The refrigerant then bypasses the upper balance weight 38 including the disk portion 38*a*. The refrigerant is thus discharged to the outside from the casing 20 through the discharge pipe 52.

(4) Detailed Structure of Lower Balance Weight 33*a* and the Surroundings

Figure 5:
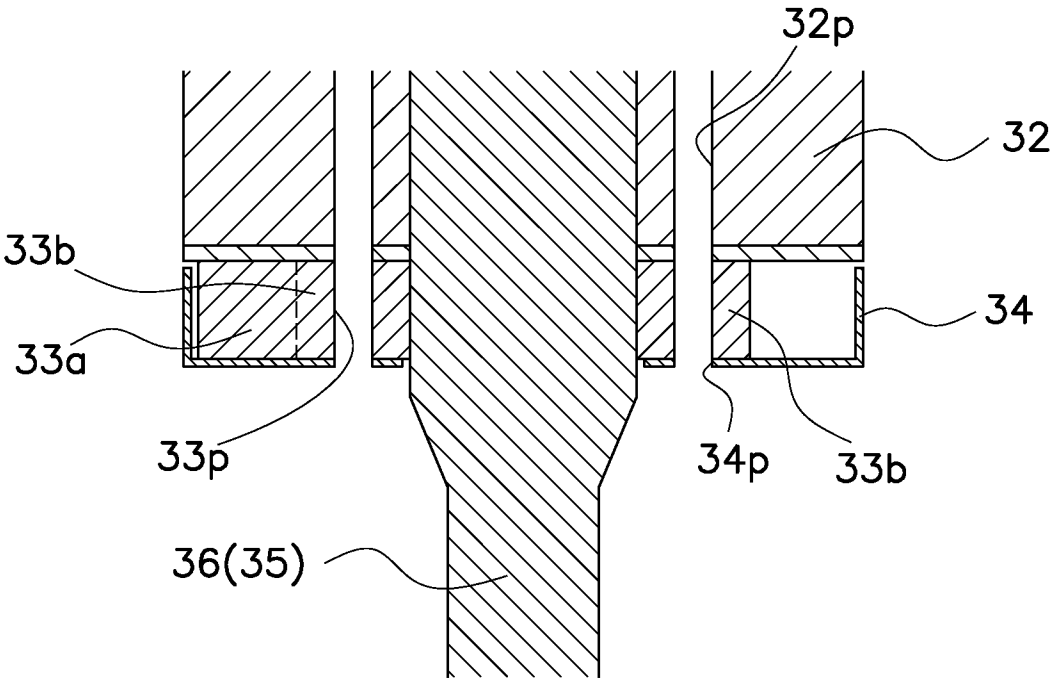
FIG. 5 is a sectional view of the lower balance weight 33*a* and the surroundings of the lower balance weight 33*a* in the compressor 10 according to the first embodiment.
Figure 6:
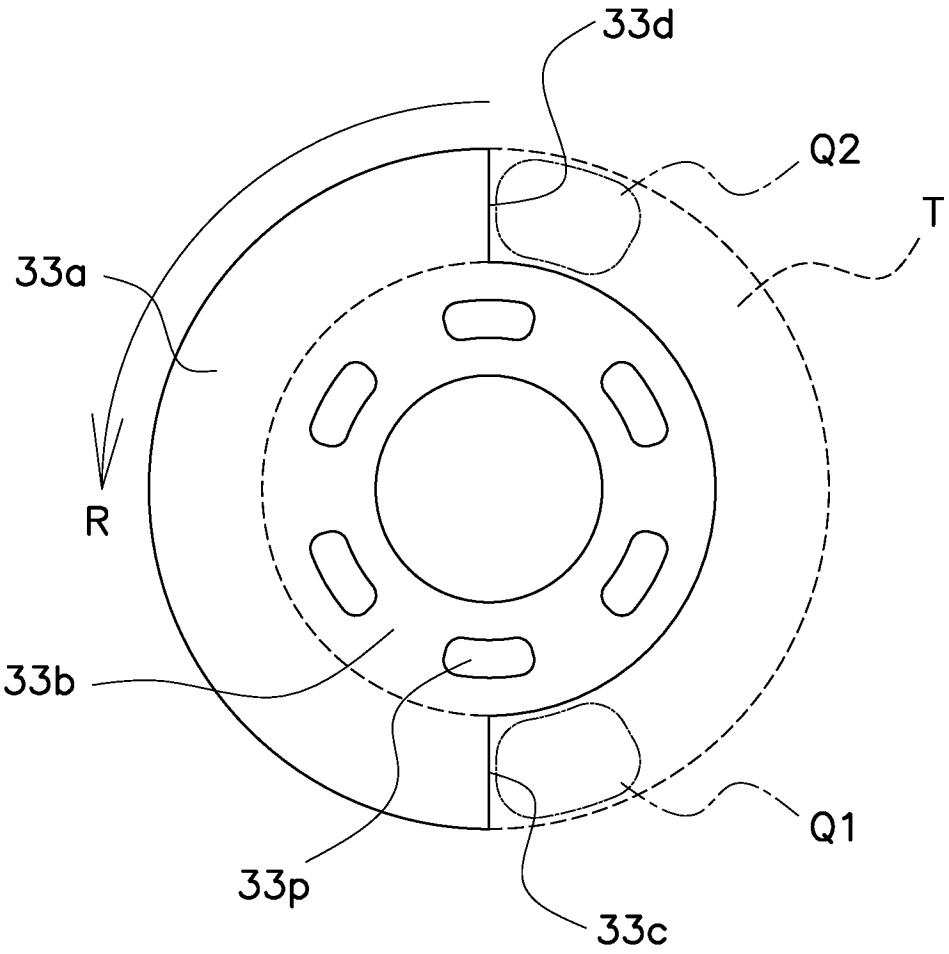
FIG. 6 is a bottom view of the lower balance weight 33*a* and the surroundings of the lower balance weight 33*a* in the compressor 10 according to the first embodiment.

FIGS. 4, 5, and 6 each illustrate a structure of the lower balance weight 33*a* and the surroundings of the lower balance weight 33*a*. The lower balance weight 33*a* is integrated with a partition 33*b*. The lower balance weight 33*a* has a shape that is asymmetric with respect to the rotational axis of the crank shaft 35. Specifically, the lower balance weight 33*a* has a shape of a circular arc. The lower balance weight 33*a* forms as its trajectory a trajectory space T along with the rotation of the rotor 32. The trajectory space T has a donut shape since the lower balance weight 33*a* does not cross the rotational axis of the rotor 32. The partition 33*b* divides the trajectory space T from the through holes 32*p*. The partition 33*b* is disposed between the crank shaft 35 and the lower balance weight 33*a*. In the first embodiment, the partition 33*b* has a plurality of holes 33*p*. Each of the holes 33*p* communicates with a corresponding one of the through holes 32*p*.

As illustrated in FIG. 4, the lower cover 34 has the plurality of holes 34*p*. Each of the holes 34*p* communicates with a corresponding one of the holes 33*p* and a corresponding one of the through holes 32*p*.

As illustrated in FIG. 6, the lower balance weight 33*a* has a front edge 33*c* and a rear edge 33*d* with respect to a rotational direction R of the rotor 32. A positive pressure generates at a front region Q1 located in front of the front edge 33*c*. A negative pressure generates at a rear region Q2 located behind the rear edge 33*d*. The lower cover 34 covers the trajectory space T. The lower cover 34 has a cylindrical shape, is fixed to the lower balance weight 33*a* or the rotor 32, and covers the lower balance weight 33*a*.

The partition 33*b* divides both the front region Q1 and the rear region Q2 from the through holes 32*p*. The refrigerant flowing through each through hole 32*p* is thus less susceptible to the influence of the positive pressure in the front region Q1 and the negative pressure in the rear region Q2.

(5) Features (5-1)

If there is no partition 33*b*, the positive pressure and the negative pressure affect the refrigerant flowing through each through hole 32*p*. Specifically, the positive pressure increases the velocity of an upward flow in each through hole 32*p*. The negative pressure decreases the velocity of the upward flow in each through hole 32*p* or changes the upward flow to a downward flow.

According to the configuration described in the first embodiment, the partition 33*b* divides both the front region Q1 and the rear region Q2 from the through holes 32*p*. The refrigerant flowing through each through hole 32*p* is thus less susceptible to the influence of the positive pressure in the front region Q1 or the negative pressure in the rear region Q2. In other words, all the through holes 32*p* allow passage of the upward flow of the refrigerant. This configuration thus secures a sectional area of the passage of the upward flow, thereby suppressing oil loss.

(5-2)

The partition 33*b* is integrated with the lower balance weight 33*a*. This configuration thus facilitates the assembly of the motor 30.

(5-3)

The through holes 32*p* communicate with the holes 33*p* in the partition 33*b*. The partition 33*b* is disposed between the crank shaft 35 and the lower balance weight 33*a*. Since the through holes 32*p* are located near the crank shaft 35, the through holes 32*p* are less likely to obstruct the flow of a magnetic field of an electromagnetic steel plate at an outer edge of the rotor 32.

(5-4)

The lower cover 34 has the cylindrical shape, and covers the lower balance weight 33*a*. The lower cover 34 thus covers the asymmetric shape of the lower balance weight 33*a*. This configuration therefore suppresses the stirring of the refrigerant and the refrigerating machine oil L by the lower balance weight 33*a*.

(6) Modifications (6-1) Modification 1A

In the first embodiment, the partition 33*s* divides both the front region Q1 and the rear region Q2 from the through holes 32*p*. Alternatively, the partition 33*s* may divide only the rear region Q2 from the through holes 32*p*.

According to this configuration, the through holes 32*p* are less susceptible to the influence of the negative pressure in the rear region Q2. The upward flow of the refrigerant in the rotor is therefore less likely to change to the downward flow.

(6-2) Modification 1B

In the first embodiment, the crank shaft 35 includes the upper balance weight 38. Alternatively, the rotor 32 may include the upper balance weight 38 similar in structure to the lower balance weight 33*a*. In addition, the partition adjacent to the upper balance weight 38 may divide only the front region Q1 from the through holes 32*p*.

According to this structure, the through holes 32*p* are less susceptible to the influence of the positive pressure in the front region Q1 on the first end surface E1 of the rotor 32. The upward flow of the refrigerant in the rotor is therefore less likely to change to the downward flow.

(6-3) Modification 1C

In the first embodiment, the partition 33*b* of the rotor 32 is integrated with the lower balance weight 33*a*. Alternatively, the partition 33*b* may be separated from the lower balance weight 33*a*. For example, the partition 33*b* may be integrated with the lower cover 34.

(6-4) Modification 1D

In the first embodiment, the lower cover 34 is fixed to the lower balance weight 33*a*. Alternatively, the lower cover 34 may be fixed to the rotor 32.

(6-5) Modification 1E

In the first embodiment, the compressor 10 is a scroll compressor. Alternatively, the compressor 10 may be a rotary compressor.

Second Embodiment (1) Configuration

Figure 7:
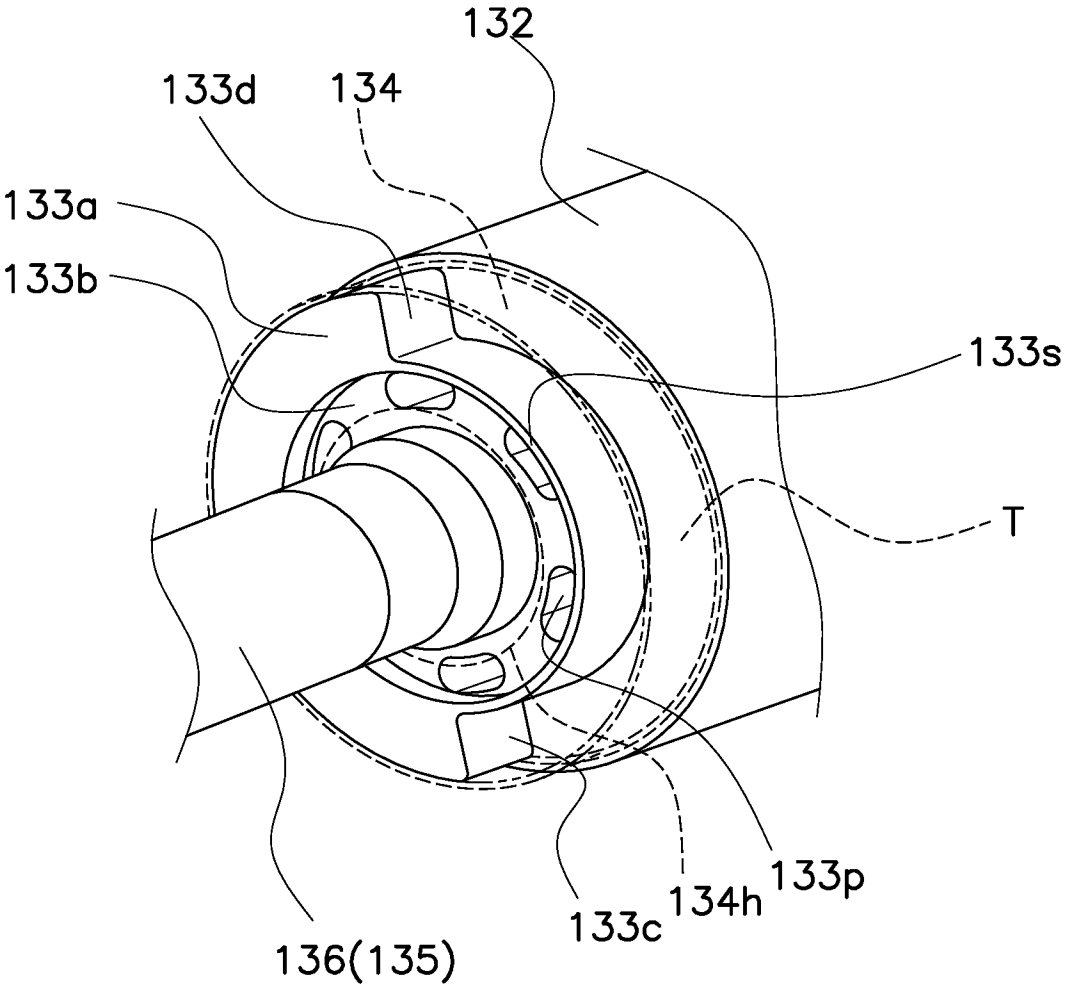
FIG. 7 is a perspective view of a lower balance weight 133*a* and the surroundings of the lower balance weight 133*a* in a compressor 10 according to a second embodiment.
Figure 8:
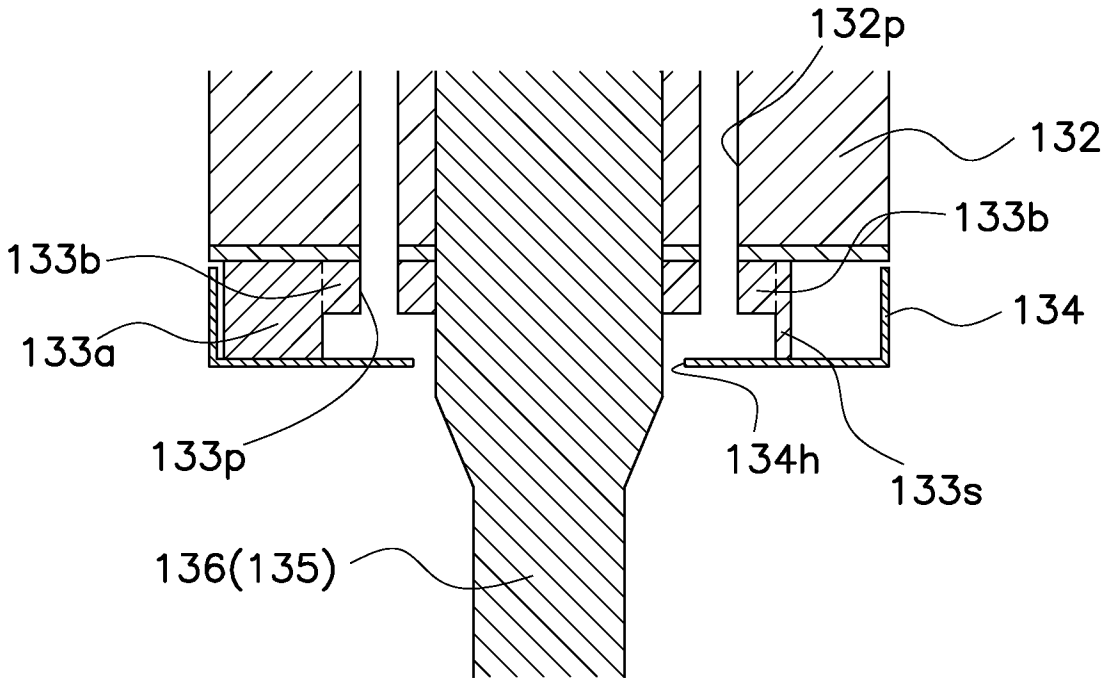
FIG. 8 is a sectional view of the lower balance weight 133*a* and the surroundings of the lower balance weight 133*a* in the compressor 10 according to the second embodiment.

FIGS. 7 and 8 each illustrate a specific structure of a lower balance weight 133*a* and the surroundings of the lower balance weight 133*a* in a compressor 10 according to a second embodiment.

In the second embodiment, the lower balance weight 133*a* is integrated with a partition 133*b* and a partition wall 133*s*. The lower balance weight 133*a* is equal in height to the partition wall 133*s*, but is different in height from the partition 133*b*. The partition 133*b* is surrounded with the lower balance weight 133*a* and the partition wall 133*s*. In the second embodiment, a lower cover 134 has one hole 134*h*. A crank shaft 135 passes through the hole 134*h*. An area of a clearance defined by the crank shaft 135 and the lower cover 134 is set to be smaller than a total sectional area of through holes 132*p*.

(2) Features

The area of the clearance between the crank shaft 135 and the lower cover 134 is smaller than the total sectional area of the through holes 132*p*. According to this configuration, the flow rate of a refrigerant is regulated in accordance with the size of the hole 134*h* in the lower cover 134. The flow rate of the refrigerant is accordingly controlled based on the shape of the lower cover 134 without depending on the structure of the through holes 132*p* in a rotor 132.

(3) Modifications (3-1) Modification 2A

Figure 9:
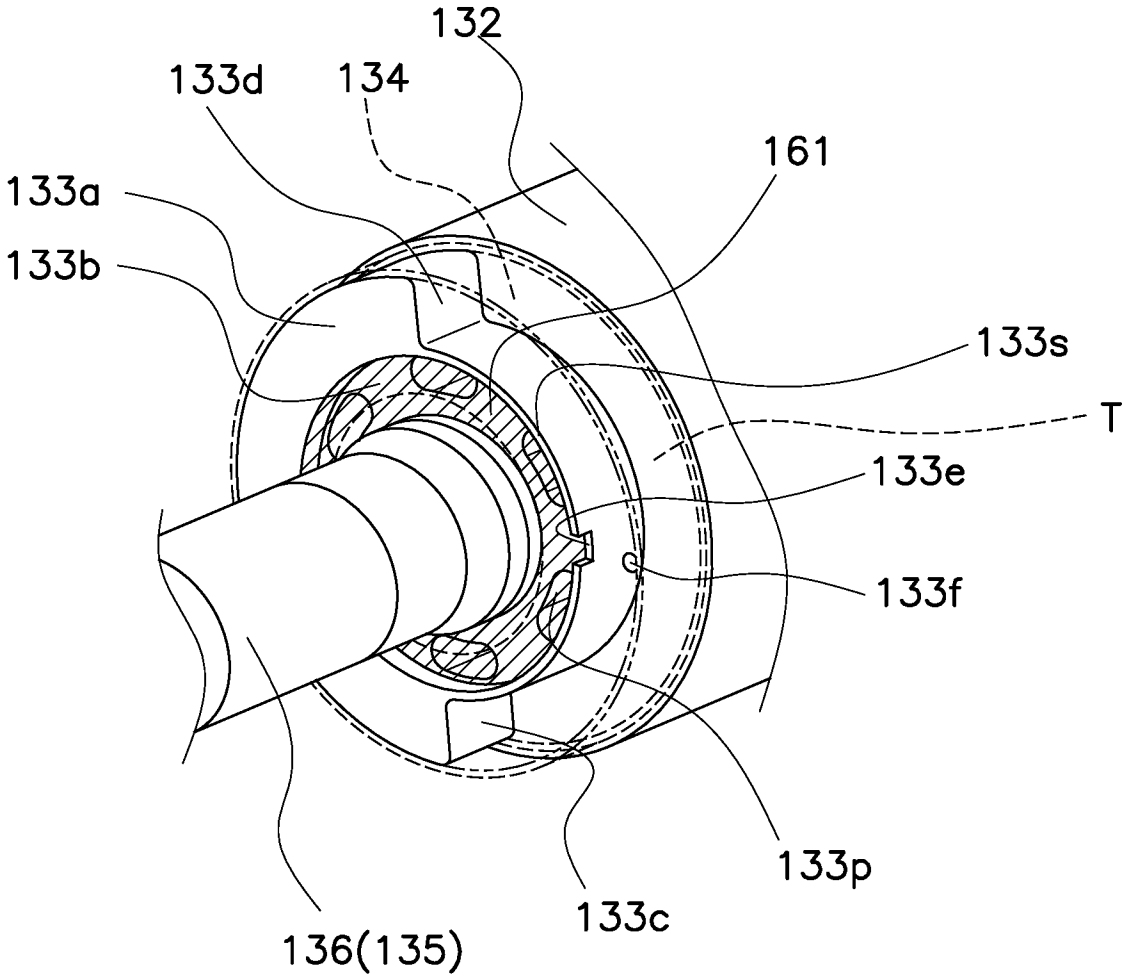
FIG. 9 is a perspective view of a lower balance weight 133*a* and the surroundings of the lower balance weight 133*a* in a compressor 10 according to Modification 2A of the second embodiment.
Figure 10:
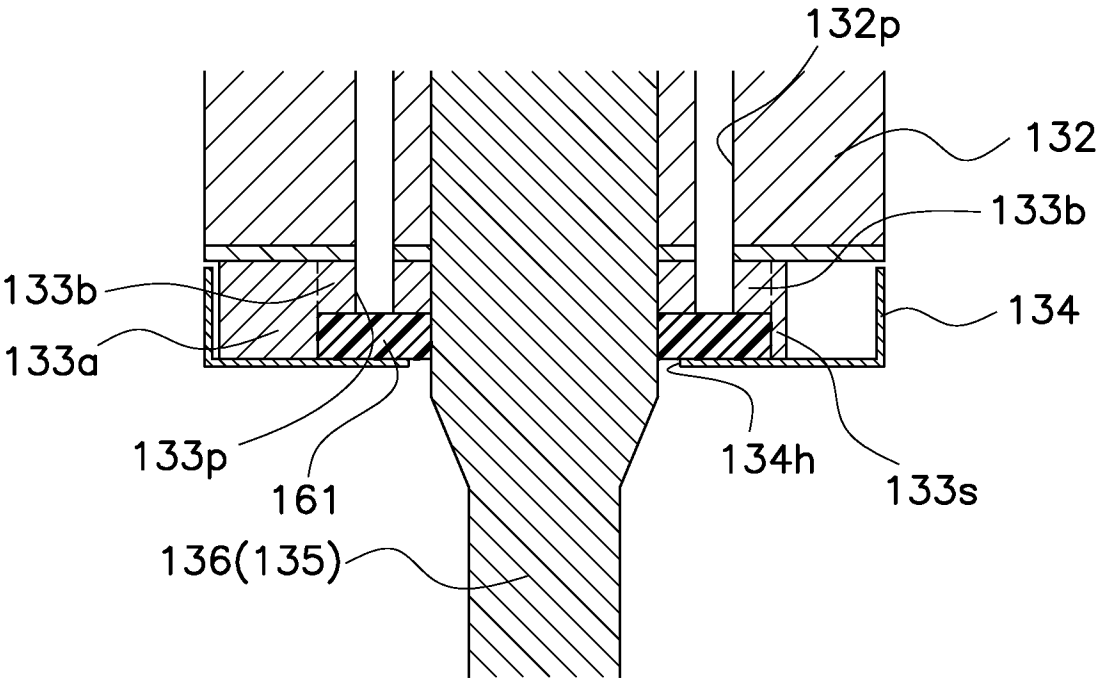
FIG. 10 is a sectional view of the lower balance weight 133*a* and the surroundings of the lower balance weight 133*a* in the compressor 10 according to Modification 2A of the second embodiment.

FIGS. 9 and 10 each illustrate a structure according to Modification 2A of the second embodiment. In Modification 2A, a porous member 161 is provided on a step defined by a lower balance weight 133*a* and a partition 133*b*. The porous member 161 covers holes 133*p* in the partition 133*b*, and also covers through holes 132*p*. In addition, a partition wall 133*s* has an oil discharge groove 133*e* and an oil discharge hole 133*f*.

According to this configuration, the holes 133*p* are covered with the porous member 161. The porous member 161 thus captures a refrigerating machine oil L passing therethrough together with a refrigerant, leading to a further reduction in oil loss. The refrigerating machine oil L captured by the porous member 161 is discharged through the oil discharge groove 133*e* and the oil discharge hole 133*f*, and then returns to an oil reservoir 20*s* through a hole 134*h* in a lower cover 134.

(3-2) Others

The modifications of the first embodiment may be applied to the second embodiment.

Third Embodiment (1) Configuration

Figure 11:
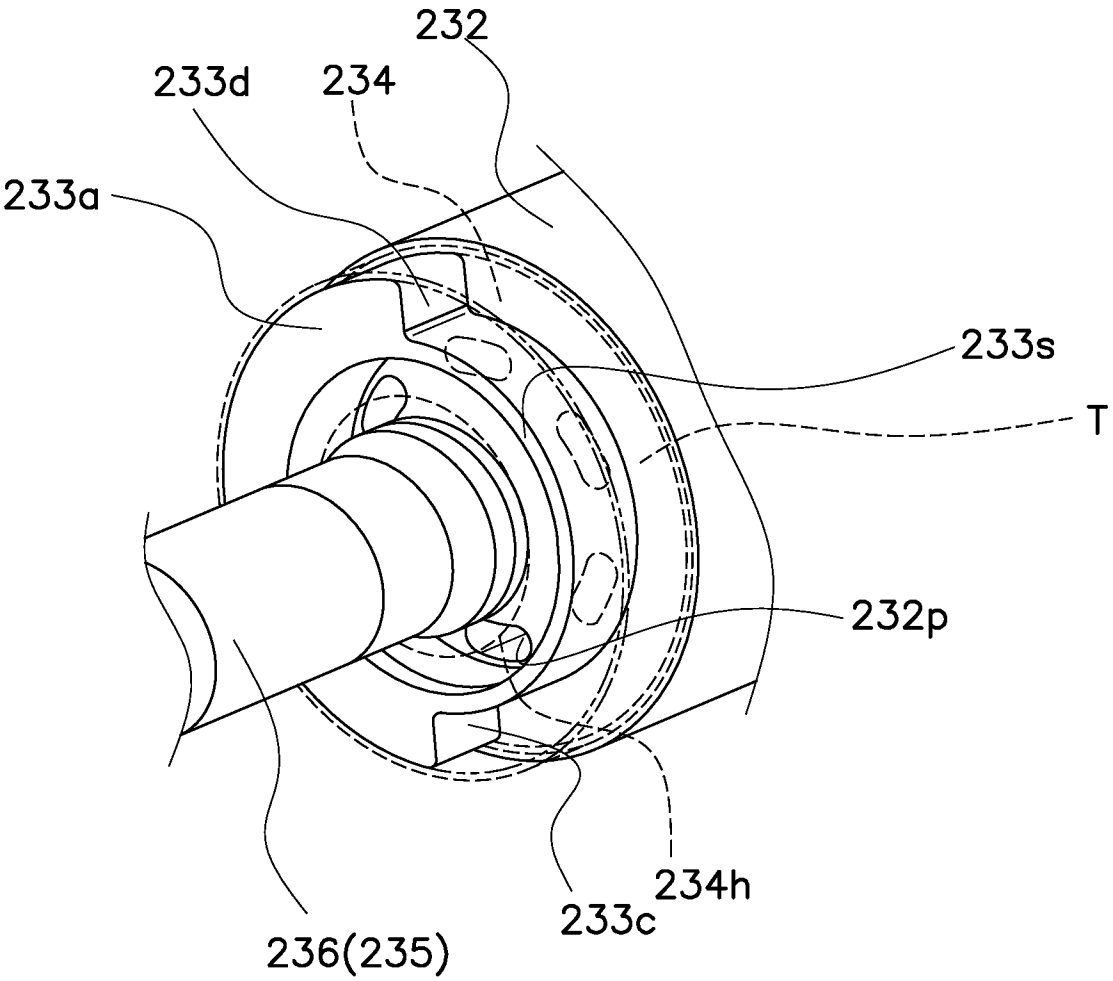
FIG. 11 is a perspective view of a lower balance weight 233*a* and the surroundings of the lower balance weight 233*a* in a compressor 10 according to a third embodiment.
Figure 12:
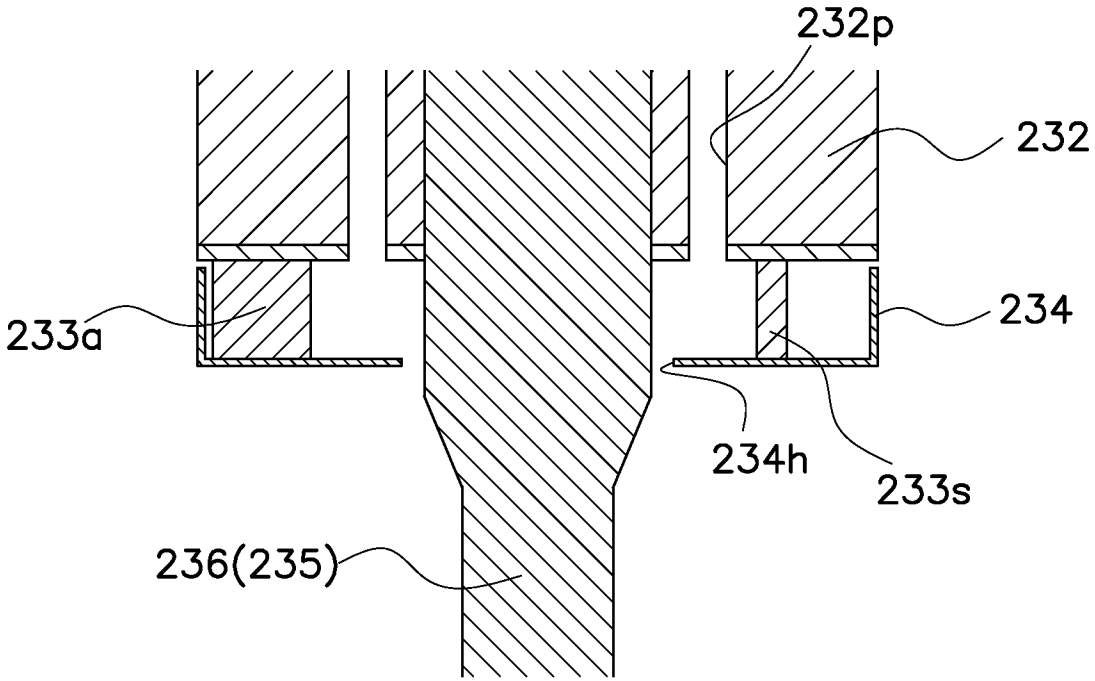
FIG. 12 is a sectional view of the lower balance weight 233*a* and the surroundings of the lower balance weight 233*a* in the compressor 10 according to the third embodiment.

FIGS. 11 and 12 each illustrate a specific structure of a lower balance weight 233*a* and the surroundings of the lower balance weight 233*a* in a compressor 10 according to a third embodiment. The third embodiment is different from the second embodiment in that through holes 232*p* in a rotor 232 are exposed. A lower cover 234 is equal in structure to the lower cover 134 in the second embodiment.

(2) Features

The through holes 232*p* in the rotor 232 are exposed. A lower balance weight 233*a* is thus produced with a smaller amount of the material.

(3) Modifications

The modifications of the first or second embodiment may be applied to the third embodiment.

<Closing>

The foregoing description concerns embodiments of the disclosure. It will be understood that numerous modifications and variations may be made without departing from the gist and scope of the disclosure in the appended claims.

REFERENCE SIGNS LIST

10: compressor
30: motor
32, 132, 232: rotor
32*p*, 132*p*, 232*p*: through hole
33*a*, 133*a*, 233*a*: lower balance weight
33*b*, 133*b*: partition
33*c*: front end
33*d*: rear end
33*p*, 133*p*: hole
133*s*, 233*s*: partition wall
34, 134, 234: lower cover
134*h*, 234*h*: hole
34*p*: hole
35, 135, 235: crank shaft
38: upper balance weight
39: upper cover
40: compression mechanism
161: porous member
E1: first end surface
E2: second end surface
L: refrigerating machine oil
Q1: front region
Q2: rear region
R: rotational direction
T: trajectory space

CITATION LIST

Patent Literature

Patent Literature 1: Japanese Patent No. 5,025,556

What is claimed is:

1. A compressor comprising:

a motor including a rotor having a first end surface and a second end surface;

a balance weight disposed on the first end surface or the second end surface; and a partition disposed on the first end surface or the second end surface, the partition being integrated with the balance weight, the partition being as thick as the balance weight, the rotor having a plurality of through holes, each of the plurality of through holes extending from the first end surface to the second end surface, the rotor including a first cylindrical portion and a second cylindrical portion, the second cylindrical portion being located on an outer side with respect to the first cylindrical portion, the plurality of through holes being disposed at the first cylindrical portion, the partition covering the first cylindrical portion at either the first end surface or the second end surface, the balance weight being disposed on the second cylindrical portion, and the partition dividing, from all of the plurality of through holes, both of a front region located in front of a front edge of the balance weight in a rotational direction of the rotor and a rear region located behind a rear edge of the balance weight in the rotational direction of the rotor.

2. The compressor according to claim 1, wherein the plurality of through holes communicate with a plurality of holes in the partition.

3. The compressor according to claim 1, further comprising:

a porous member covering e plurality of through holes.

4. The compressor according to claim 3, further comprising:

a cover having a cylindrical shape, the cover being fixed to the balance weight or the rotor, and the cover covering the balance weight.

5. The compressor according to claim 1, further comprising:

a cover having a cylindrical shape, the cover being fixed to the balance weight or the rotor, and the cover covering the balance weight.

6. The compressor according to claim 1, wherein the compressor is either a rotary compressor or a scroll compressor.

* * * * *